US009768547B1

(12) United States Patent
Lindstrom et al.

(10) Patent No.: US 9,768,547 B1
(45) Date of Patent: Sep. 19, 2017

(54) WATER AND INGRESS RESISTANT AUDIO PORT

(71) Applicant: Sprint Communications Company L.P., Overland Park, KS (US)

(72) Inventors: Ryan Christopher Lindstrom, Olathe, KS (US); Patrick J. Hills, Olathe, KS (US); Richard Aaron Reiser, Wellington, FL (US); Andrew Lawrence Liszewski, Kansas City, MO (US)

(73) Assignee: Sprint Communications Company L.P., Overland Park, KS (US)

( * ) Notice: Subject to any disclaimer, the term of this patent is extended or adjusted under 35 U.S.C. 154(b) by 0 days.

(21) Appl. No.: 15/287,455

(22) Filed: Oct. 6, 2016

Related U.S. Application Data

(63) Continuation of application No. 14/684,789, filed on Apr. 13, 2015, now Pat. No. 9,484,664.

(51) Int. Cl.

| | |
|---|---|
| ***H01R 13/44*** | (2006.01) |
| ***H01R 13/52*** | (2006.01) |
| ***H01R 24/58*** | (2011.01) |
| *H01R 105/00* | (2006.01) |

(52) U.S. Cl.
CPC ..... *H01R 13/5219* (2013.01); *H01R 13/5213* (2013.01); *H01R 24/58* (2013.01); *H01R 2105/00* (2013.01)

(58) Field of Classification Search
CPC ..... H01R 13/4538; H01R 24/58
USPC ..... 439/140, 141, 668, 669
See application file for complete search history.

(56) References Cited

U.S. PATENT DOCUMENTS

| | | | |
|---|---|---|---|
| 1,394,057 | A | 10/1921 | Woernley |
| 4,174,875 | A | 11/1979 | Bayha et al. |
| 4,589,717 | A | 5/1986 | Pottier et al. |
| 5,171,158 | A | 12/1992 | Cairns et al. |
| 5,387,136 | A | 2/1995 | Britton et al. |
| 5,484,296 | A | 1/1996 | Taylor et al. |
| 5,518,411 | A | 5/1996 | Belleci et al. |
| 5,572,109 | A | 11/1996 | Keith |
| 5,661,268 | A | 8/1997 | Freeman et al. |
| 6,767,228 | B2 | 7/2004 | Katz |
| 7,322,858 | B1 | 1/2008 | Rogers et al. |
| 7,427,216 | B1 | 9/2008 | Wu et al. |
| 7,484,981 | B2 | 2/2009 | Garcia et al. |

(Continued)

FOREIGN PATENT DOCUMENTS

| | | | |
|---|---|---|---|
| GB | 894284 | A | 4/1962 |

*Primary Examiner* — Thanh Tam Le

(57) ABSTRACT

A water resistant port and a method for using it are provided. The port comprises a moveable seal assembly coupled to a spring structure. The moveable seal assembly may comprise a plastic material on an inner surface and a seal material on an outer surface. When the spring structure is in a relaxed position, the moveable seal assembly is caused to create a seal with a gasket material coupled to a side wall of a port casing. The spring structure comprises a spring coupled to the moveable seal assembly at one end and to a guide at an opposite end in an interior portion of the port casing. The port casing comprises, on an interior surface, one or more electrical connectors adapted to receive one or more electrical contacts of an accessory plug when the spring structure is compressed and the moveable seal assembly is in an engaged position.

18 Claims, 4 Drawing Sheets

(56) References Cited

U.S. PATENT DOCUMENTS

| | | | | |
|---|---|---|---|---|
| 8,100,726 | B2 | 1/2012 | Harlan et al. | |
| 8,641,446 | B1 | 2/2014 | Chen | |
| 9,028,264 | B2 * | 5/2015 | Head | H01R 13/00 439/140 |
| 9,039,434 | B2 | 5/2015 | Winningham et al. | |
| 9,040,822 | B2 | 5/2015 | Nieto Lopez | |
| 9,270,051 | B1 * | 2/2016 | Christiansen | H01R 13/523 |
| 9,484,664 | B1 * | 11/2016 | Lindstrom | H01R 13/521 |

* cited by examiner

WATER AND INGRESS RESISTANT AUDIO PORT

CROSS-REFERENCE TO RELATED APPLICATION

This application claims priority to U.S. patent application Ser. No. 14/684,789, filed Apr. 13, 2015, and titled "Water and Ingress Resistant Audio Port," the entire contents of which is incorporated herein by reference in its entirety.

SUMMARY

A high level overview of various aspects of the invention is provided here for that reason, to provide an overview of the disclosure and to introduce a selection of concepts that are further described below in the detailed-description section below. This summary is not intended to identify key features or essential features of the claimed subject matter, nor is it intended to be used as an aid in isolation to determine the scope of the claimed subject matter.

In brief, and at a high level, this disclosure describes, among other things, a water and ingress resistant port that is used, for example, to prevent water and/or other substances from entering an audio jack in a mobile device. The port is automatically and without relying on human intervention closed and sealed to prevent water and/or other substances from entering the port after an accessory plug (e.g., audio jack) is removed from the port. This eliminates the need for a user to remember to close or properly close a port cover that may be provided by a case that covers the mobile device.

The port generally comprises a moveable seal assembly coupled to a spring structure. The moveable seal assembly may comprise a plastic material on an inner surface and a seal material on an outer surface. When the spring structure is in a relaxed position, the moveable seal assembly is caused to create a seal with a gasket material coupled to a side wall of a port casing. The spring structure comprises at least one spring coupled to the moveable seal assembly at one end and to a guide at an opposite end in an interior portion of the port casing. The port casing comprises, on an interior surface, one or more electrical connectors adapted to receive one or more electrical contacts of an accessory plug when the spring structure is compressed and the moveable assembly is in an engaged position.

BRIEF DESCRIPTION OF THE DRAWINGS

Illustrative embodiments of the present invention are described in detail below with reference to the attached drawings figures, and wherein.

DETAILED DESCRIPTION

Figure 1:
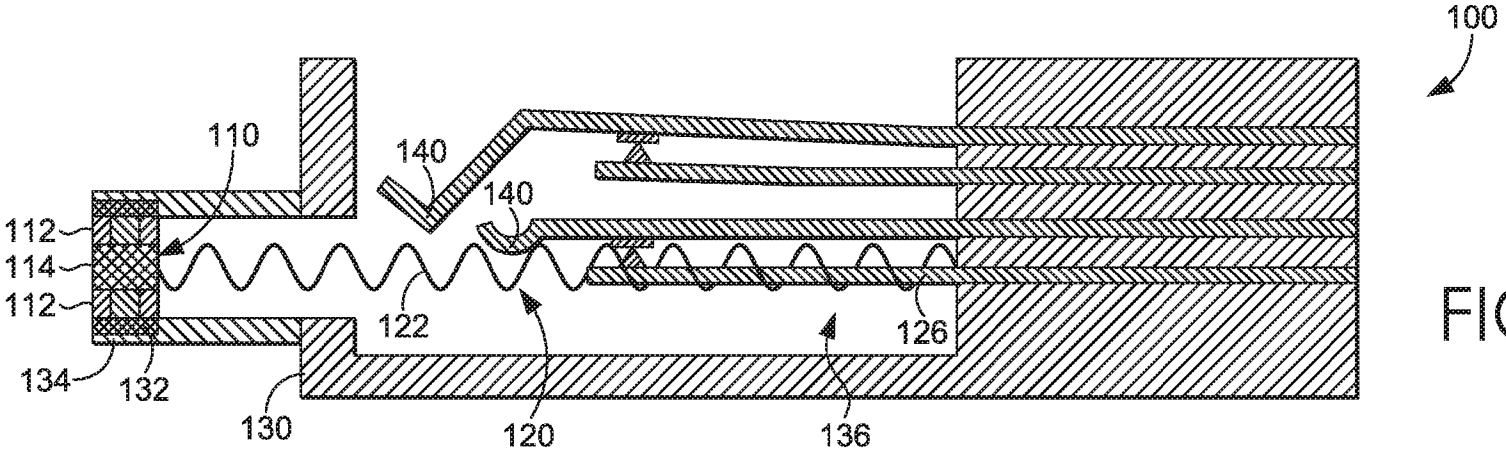
FIG. 1 depicts a side plan view of an exemplary water resistant port in accordance with an embodiment of the technology.

The subject matter of select embodiments of the present invention is described with specificity herein to meet statutory requirements. But the description itself is not intended to define what we regard as our invention, which is what the claims do. The claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Throughout this disclosure, acronyms and shorthand notations may be used to aid the understanding of certain concepts pertaining to the associated system and services. These acronyms and shorthand notations are intended to help provide an easy methodology of communicating the ideas expressed herein and are not meant to limit the scope of the present invention. Further, various technical terms are used throughout this description. An illustrative resource that fleshes out various aspects of these terms can be found in Newton's Telecom Dictionary, 27th Edition (2013).

Mobile devices can be damaged by water and/or other substances. Although some damage can be prevented by water resistant cases, the cases do not always protect ports for the device. For example, various ports on the device allow for entry of an accessory plug (e.g., a charging cable, an audio jack, and the like). These ports, if protected at all by the case, rely on the user remembering to manually secure some type of case attachment or fitting on or over the port. Even when the user remembers, if this is not done properly, the port may still allow entry of water and/or other substances.

Examples of the present invention are directed towards a water and/or ingress resistant port. The water and/or ingress resistant port is used, for example, to prevent water and/or other substances from entering a port (e.g., an audio jack) in a mobile device. The port is automatically and without relying on human intervention closed and sealed to prevent water and/or other substances from entering the port after an accessory plug (e.g., audio jack) is removed from the port. This eliminates the need for a user to remember to close or properly close a port cover that may be provided by a case that covers the mobile device.

Accordingly, in a first aspect, a water resistant port for receiving an accessory plug is provided. The water resistant port comprises a moveable seal assembly coupled to a spring structure. The moveable seal assembly includes a plastic material on an inner surface and a seal material on an outer surface that, when the spring structure is in a relaxed position, causes the moveable seal assembly to create a seal with a gasket material coupled to a side wall of a port casing. The spring structure includes at least one spring coupled to the moveable seal assembly at one end and to a guide at an opposite end in an interior portion of the port casing. The port casing includes, on an interior surface, one or more electrical connectors adapted to receive one or more electrical contacts of the accessory plug when the spring structure is compressed and the moveable seal assembly is in an engaged position.

In a second aspect, a water resistant port for receiving an accessory plug is provided. The water resistant port comprises a moveable seal assembly coupled to a spring structure. The moveable seal assembly is, automatically and without user intervention, in a sealed position when an accessory plug is removed from the port. The spring structure includes a spring coupled to the moveable seal assembly. The interior surface of the port casing includes one or more electrical connectors.

In a third aspect, a method for automatically sealing a water resistant port is provided. The method comprises receiving, at a moveable seal assembly that is in a sealed position with a gasket material coupled to a side wall of a port casing, an accessory plug. The moveable seal assembly is coupled to a spring structure and comprises a plastic material on an inner surface and a seal material on an outer surface. The method also comprises upon, receiving the accessory plug at the moveable seal assembly, the accessory plug displacing the moveable seal assembly towards an opposite end of the port casing and compressing at least one spring of the spring structure, causing one or more electrical connectors on an interior portion of the port casing to be revealed. The method further comprises receiving, at the one or more electrical connectors, one or more electrical contacts of an accessory plug.

Turning now to FIG. 1, a side plan view of an exemplary water resistant port and is referenced generally by the numeral 100. The water resistant port 100 generally comprises a moveable seal assembly 110 coupled to a spring structure 120. The moveable seal assembly 110 may be constructed of a durable material such as, for example, hard plastic on an inner surface 114 and a seal material such as, for example, rubber or silicon on an outer surface 112. The outer surface 112 of the moveable seal assembly 110 is configured to create a seal with a gasket material 132 coupled to a side wall 134 of a port casing 130.

The spring structure 120 comprises at least one spring 122 coupled to the moveable seal assembly 110 at one end. The spring 122 is coupled to a guide 126 at an opposite end in an interior portion 136 of the casing. When the spring structure 120 is in a relaxed position, the moveable seal assembly 110 is caused to move towards the outer portion of the port casing. This allows the seal material on the outer surface 112 of the moveable seal assembly 110 to create the seal with the gasket material 132 coupled to the side wall 134 of the port casing 130.

The port casing 130 comprises, on an interior surface, one or more electrical connectors 140. The electrical connectors 140 are adapted to receive one or more electrical contacts of an accessory plug when the spring structure 120 is compressed (not shown in FIG. 1) and the moveable seal assembly 110 is in an engaged position (also not shown in FIG. 1).

In embodiments, the port casing 130 is adapted to receive various types of accessory plugs. For example, the port casing 130 may be adapted to receive one of a tip ring (TRS) plug, a tip sleeve (TS) plug, a tip ring ring sleeve (TRRS) plug, a universal serial bus (USB) plug, a high-definition multimedia interface (HDMI) plug, and/or a direct current (DC) plug. In each of these examples, when the port casing 130 receives the accessory plug, the accessory plug displaces the moveable seal assembly 110 towards the interior portion 136 (i.e., opposite end) of the port casing 130.

As a result of the displacement of the moveable seal assembly 110, the electrical connectors 140 engage the accessory plug and an electrical connection is made. In some embodiments, the electrical connectors 140 on the interior surface of the port casing 130 are leaf springs (as shown in FIG. 1). In other embodiments, the electrical connectors 140 on the interior surface of the port casing 130 are spring-loaded connectors.

As can be appreciated, when the accessory plug is removed, the spring structure 120 returns to a relaxed position. This causes the moveable seal assembly to return to a disengaged position near the exterior of the port casing 130. As mentioned previously, in this position, the seal material of the moveable seal assembly creates a seal with the gasket material coupled to the side wall of the port casing, automatically and without user intervention, which prevents water and other substances from entering the port casing 130 when the port is not in use.

Figure 2:
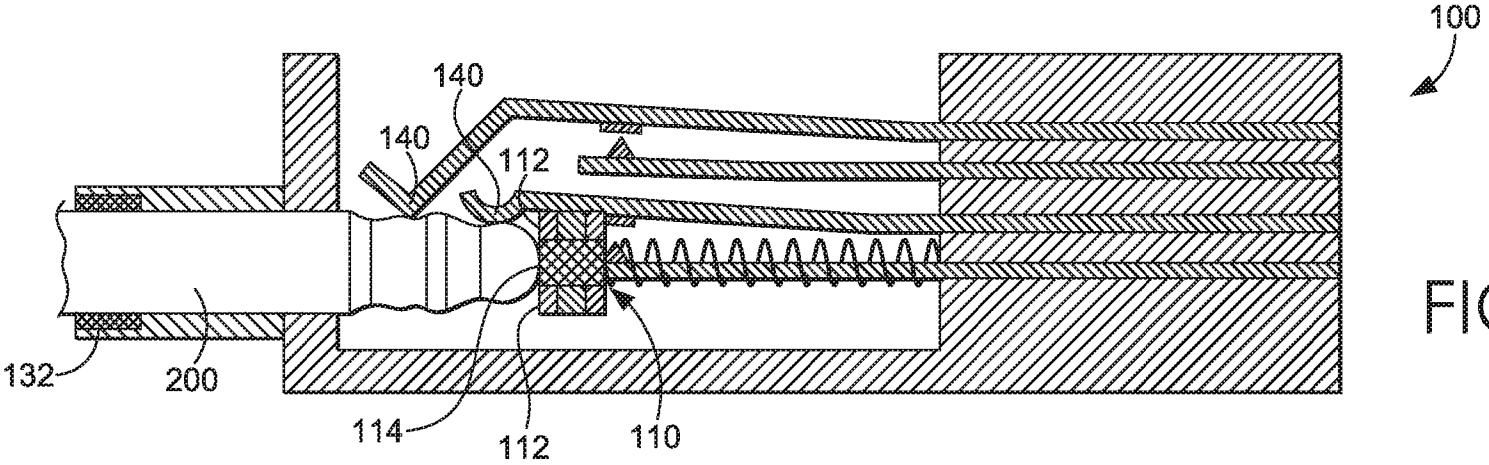
FIG. 2 depicts a side plan view of an accessory plug being received into the exemplary water resistant port of FIG. 1 in accordance with an embodiment of the technology.

FIG. 2 depicts a side plan view of an accessory plug being received into the exemplary water resistant port 100 of FIG. 1 in accordance with an embodiment of the technology. As seen in FIG. 2, an accessory plug 200 has been received into the port casing 130. Although the accessory plug 200 is depicted as a TRS plug, it is contemplated that any type of accessory plug can be received into the port casing 130 provided the electrical connectors 140 on the interior of the port casing are configured to make an electrical connection with the accessory plug 200.

As shown in FIG. 2, the accessory plug 200 has displaced the moveable seal assembly 110 towards the interior portion (i.e., opposite end) of the port casing 130. To prevent wear and tear on the moveable seal assembly 110, the moveable seal assembly 110 is adapted to receive the accessory plug 200 at the inner surface 114 of the moveable seal assembly 110, which is constructed of a durable material such as, for example, hard plastic. This prevents the seal material from becoming worn by the accessory plug and ineffective at maintaining the seal with the gasket material 132. As a result of the displacement of the moveable seal assembly 110, the electrical connectors 140 engage the accessory plug 200 and an electrical connection is made.

Figure 3:
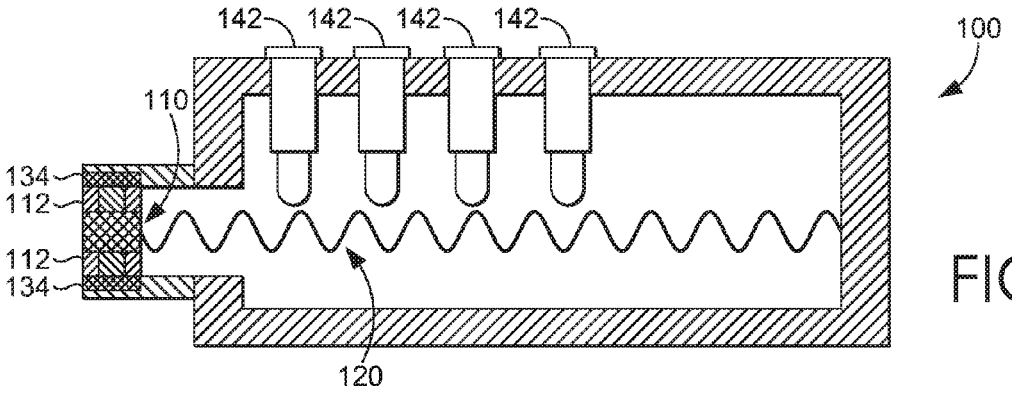
FIGS. 3 and 4 depict side plan views of an exemplary water resistant port in accordance with an embodiment of the technology.
Figure 4:
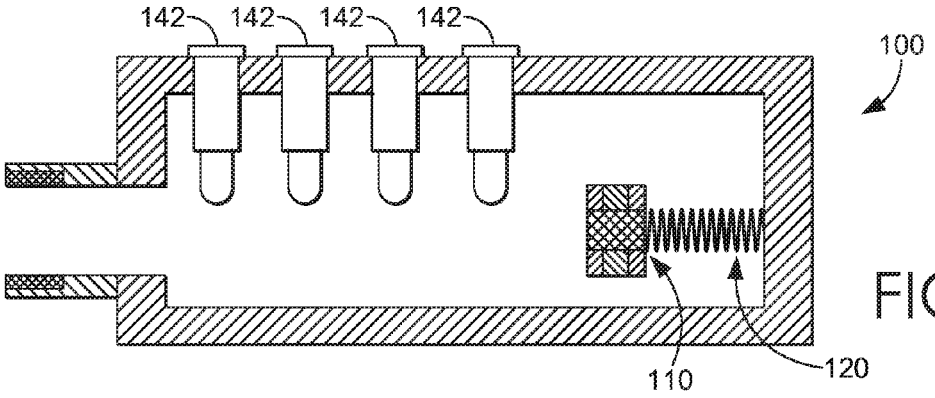

Referring now to FIGS. 3 and 4, side plan views of an exemplary water resistant port 100 are depicted in accordance with an embodiment of the technology. Initially, with reference to FIG. 3, the spring structure 120 is in a relaxed position. As shown, the moveable seal assembly 110 is in a sealed position and the seal material of the moveable seal assembly is aligned with the gasket material 132 of the port casing to create a seal. As can be appreciated the seal prevents the electrical connectors 142 from being exposed to damaging elements (e.g., water and/or other substances) that are unable to enter the port.

In FIG. 4, the spring structure 120 is in a compressed position. As shown, the moveable seal assembly 110 is in an engaged position. This reveals the electrical connectors 142 and exposes the port to an accessory plug (not shown in FIG. 4). For clarity, the spring structure 120 is only in the compressed position when the moveable seal assembly 110 is displaced, such as by an accessory plug. Otherwise, the spring structure 120, automatically and without user intervention, returns to the relaxed position shown in FIG. 3, causing the moveable seal assembly 110 to return to the sealed position.

Figure 5:
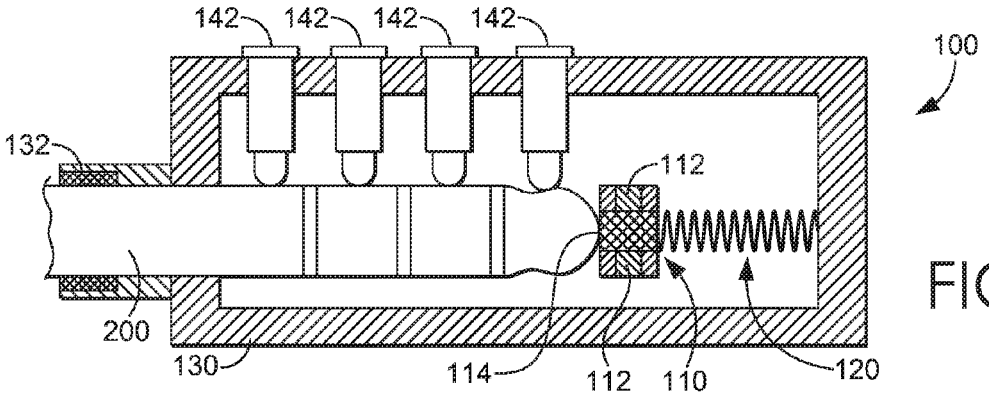
FIG. 5 depicts a side plan view of an accessory plug being received into the exemplary water resistant port of FIGS. 3 and 4 in accordance with an embodiment of the technology.

Turning to FIG. 5, a side plan view of an accessory plug being received into the exemplary water resistant port 100 of FIGS. 3 and 4 is depicted in accordance with an embodiment of the technology. As shown in FIG. 5, an accessory plug 200 has been received into the port casing 130. Although the accessory plug 200 is depicted as a TRRS plug, it is contemplated that any type of accessory plug can be received into the port casing 130 provided the electrical connectors 142 on the interior of the port casing are configured to make an electrical connection with the accessory plug 200.

As shown in FIG. 5, the accessory plug 200 has displaced the moveable seal assembly 110 towards the interior portion (i.e., opposite end) of the port casing 130. To prevent wear and tear on the moveable seal assembly 110, the moveable seal assembly 110 is adapted to receive the accessory plug 200 at the inner surface 114 of the moveable seal assembly 110, which is constructed of a durable material such as, for example, hard plastic. This prevents the seal material 112 from becoming worn and ineffective at maintaining the seal with the gasket material 132. As a result of the displacement of the moveable seal assembly 110, the electrical connectors 142 engage the accessory plug 200 and an electrical connection is made.

Figure 6:
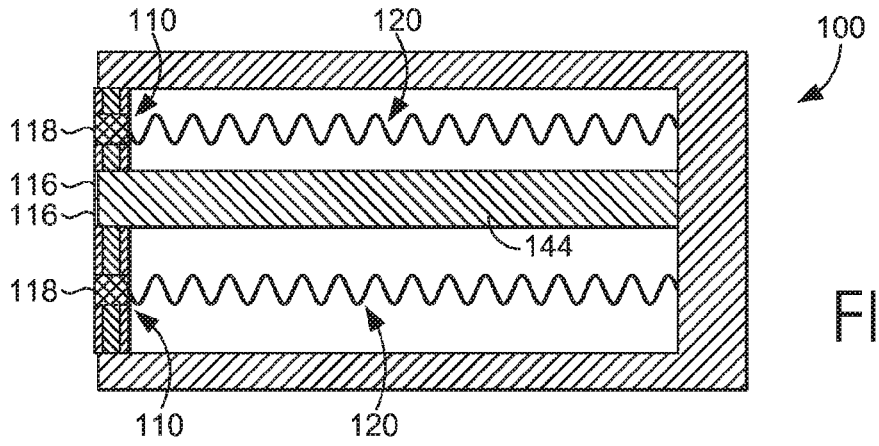
FIGS. 6 and 7 depict a side plan view of an exemplary water resistant port in accordance with an embodiment of the technology.
Figure 7:
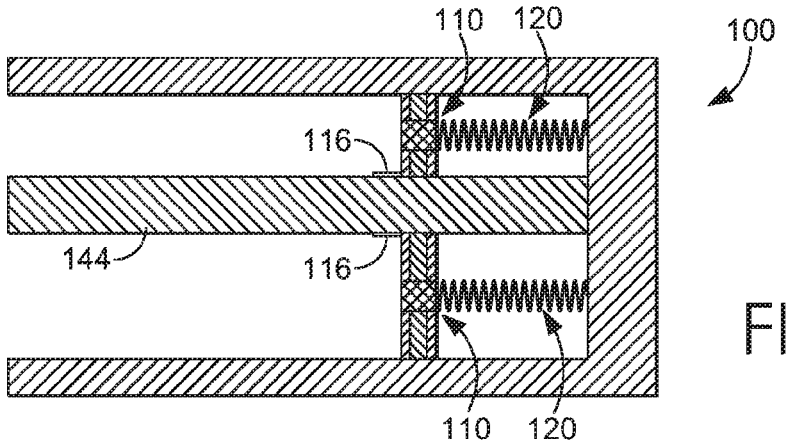

FIGS. 6 and 7 depict a side plan view of an exemplary water resistant port 100 in accordance with an embodiment of the technology. Initially, with reference to FIG. 6, the spring structures 120 are in a relaxed position. As shown, the moveable seal assemblies 110 are in a sealed position and the seal materials 116 for each of the moveable seal assemblies 110 are aligned with each other to create a seal. As can be appreciated the seal prevents the electrical connector 144 from being exposed to damaging elements (e.g., water and/or other substances) that are unable to enter the port. The outer surface 118 of each moveable seal assembly 110 is constructed of a durable material such as, for example, hard plastic. This prevents the seal materials 116 from becoming worn by the accessory plug and ineffective at maintaining the seal with each other.

In FIG. 7, the spring structures 120 are in a compressed position. As shown, the moveable seal assemblies 110 are in an engaged position. This causes the seal materials 116 to separate and move with the moveable seal assemblies 110 towards the interior of the port on either side of the electric connector 144. Accordingly, the electrical connector 144 is revealed and the port is exposed to an accessory plug (not shown in FIG. 7). For clarity, the spring structures 120 are only in the compressed position when the moveable seal assemblies 110 are displaced, such as by an accessory plug (i.e., in this instance, a USB plug). Otherwise, the spring structures 120, automatically and without user intervention, return to the relaxed position shown in FIG. 6, causing the moveable seal assemblies 110 to return to the sealed position.

Figure 8:
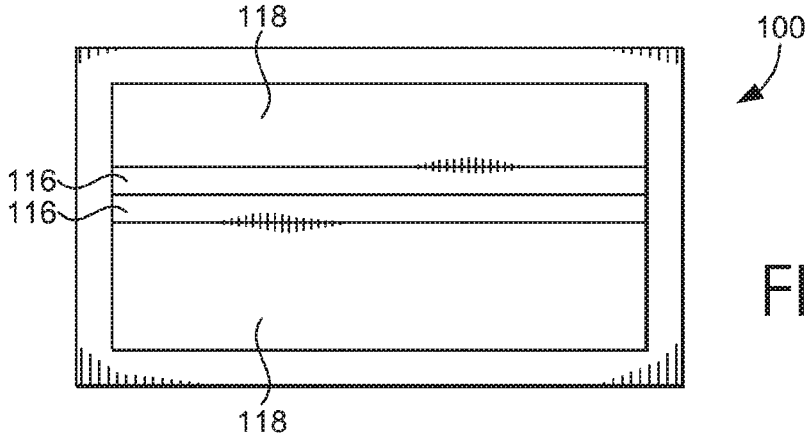
FIG. 8 depicts a top plan view of the exemplary water resistant port of FIGS. 6 and 7 in accordance with an embodiment of the technology.

Referring now to FIG. 8, a top plan view of the exemplary water resistant port 100 of FIGS. 6 and 7 is depicted in accordance with an embodiment of the technology. As shown, the moveable seal assemblies are in a sealed position. In the sealed position, the seal materials 116 of each moveable seal assembly create a seal with each other and prevent water and/or other substances from entering the port 100. The outer surfaces 118 of each moveable seal assembly are constructed of a durable material such as, for example, hard plastic. This prevents the seal materials 116 from becoming worn by the accessory plug and ineffective at maintaining the seal with each other.

Figure 9:
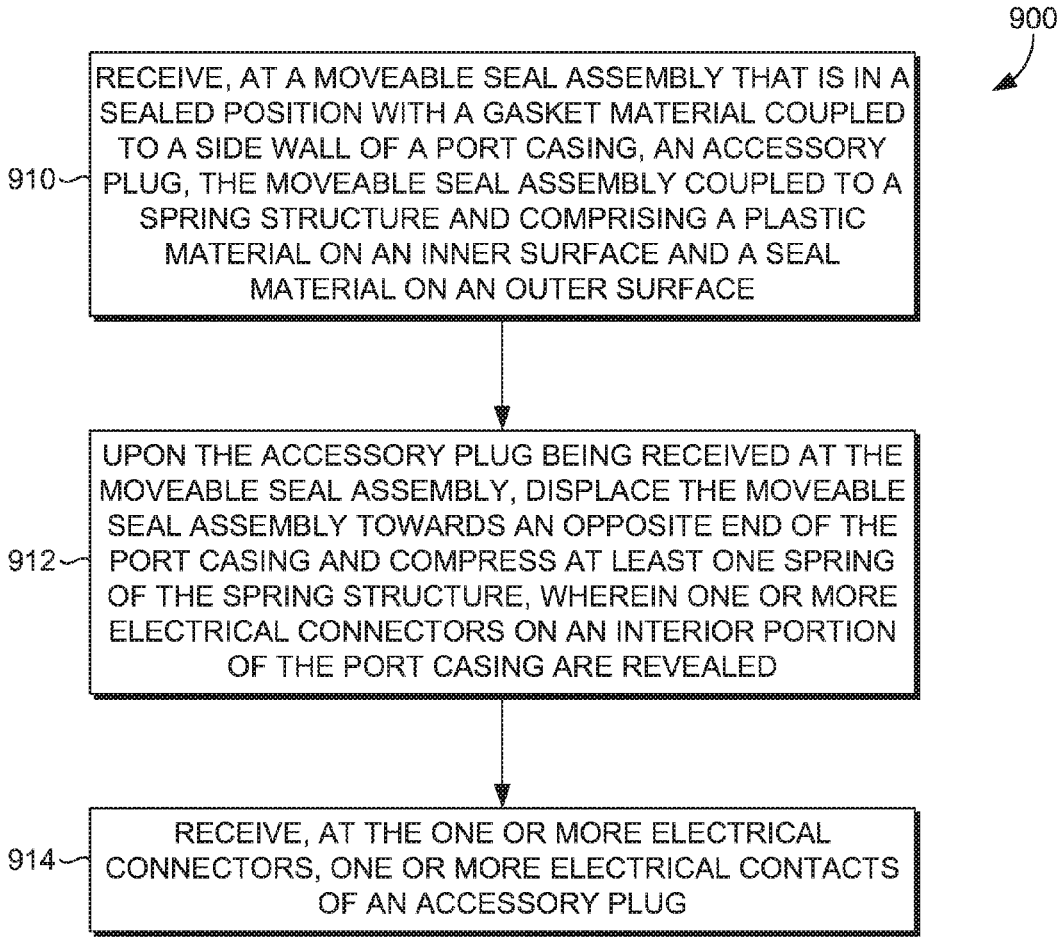
FIG. 9 depicts a flow diagram of an exemplary method of automatically sealing a water resistant port in accordance with an embodiment of the technology.

Turning now to FIG. 9, a flow diagram of an exemplary method 900 of automatically sealing a water resistant port is provided. Initially, at step 910, an accessory plug is received at a moveable seal assembly that is in a sealed position with a gasket material coupled to a side wall of a port casing. The moveable seal assembly is coupled to a spring structure and comprises a plastic material on an inner surface and a seal material on an outer surface. The plastic material provides resistance to normal wear and tear from receiving the accessory plug and the seal material creates a seal with the gasket material coupled to the side wall of the port casing when the accessory plug is removed.

At step 912 and upon receiving the accessory plug at the moveable seal assembly, the accessory plug displaces the moveable seal assembly towards an opposite end of the port casing and compresses at least one spring of the spring structure. This causes one or more electrical connectors on an interior portion of the port casing to be revealed. In contrast, when the accessory plug is removed, the spring of the spring structure automatically moves to a relaxed position. This causes the moveable seal assembly to, automatically and without user intervention, move back towards the exterior end of the port casing in a sealed position (i.e., the seal material of the moveable seal assembly engaging with the gasket material coupled to the side wall of the port casing).

One or more electrical contacts of an accessory plug are received, at step 914, at the one or more electrical connectors. The electrical connectors may be adapted to receive on of: a tip ring sleeve (TRS) plug, a tip sleeve (TS) plug, a tip ring ring sleeve (TRRS) plug, a universal serial bus (USB) plug, a high-definition multimedia interface (HDMI) plug, or a direct current (DC) plug.

The water resistant port may comprise any of the water resistant ports discussed above with respect to FIGS. 1-8. As such, the water resistant port may comprise a water resistant port adapted to receive any type of accessory plug. Similarly, the water resistant port may be configured to automatically seal any type of port on any type of device utilizing any type of spring structure.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A water-resistant port for an accessory plug, comprising:

a port casing comprising an interior wall that defines an interior portion of the port casing;

a moveable seal assembly;

one or more electrical connectors moveably coupled to the interior wall of the port casing;

a spring structure coupled to the interior wall and to the moveable seal assembly; and a guide extending from the interior wall through a center of the spring structure, wherein the moveable seal assembly is moveable between a relaxed position and an engaged position by insertion of the accessory plug, wherein, in the relaxed position, the moveable seal assembly provides a seal against a side wall of the port casing, and wherein, in the engaged position, the spring structure is compressed and the accessory plug contacts the one or more electrical connectors.

2. The water-resistant port of claim 1, wherein the moveable seal assembly further comprises an inner surface coupled to the spring structure, an outer surface, and a gasket material coupled to the side wall of the port casing.

3. The water-resistant port of claim 2, wherein the inner surface comprises a durable material and the outer surface comprises a seal material.

4. The water-resistant port of claim 2, wherein, in the relaxed position, the seal is created between the outer surface and the gasket material, and wherein, in the engaged position, the accessory plug moveably displaces the one or more electrical connectors.

5. The water-resistant port of claim 1, wherein the one or more electrical connectors comprise:

leaf springs; or spring loaded connectors, wherein the one or more electrical connectors are moveable relative to the interior wall when engaged by the accessory plug.

6. The water-resistant port of claim 1, wherein the accessory plug comprises:

a tip ring sleeve (TRS) plug;

a tip sleeve (TS) plug;

a tip ring ring sleeve (TRRS) plug;

a universal serial bus (USB) plug;

a high-definition multimedia interface (HDMI) plug; or a direct current (DC) plug.

7. The water-resistant port of claim 1, wherein the one or more electrical connectors are moveable perpendicular to a direction of insertion of the accessory plug.

8. The water-resistant port of claim 1, wherein the relaxed position comprises a sealed position that seals the interior portion.

9. A water-resistant port, comprising:

a port casing having an interior wall that defines an interior portion of the port casing;

a moveable seal assembly;

one or more electrical connectors moveably coupled to the interior wall of the port casing;

a spring structure coupled to the interior wall and extending to the moveable seal assembly;

a guide extending from the interior wall through a center of the spring structure; and an accessory plug, wherein the moveable seal assembly is moveable between a relaxed position when the accessory plug is not inserted and an engaged position when the accessory plug is inserted into the port casing by depressing the moveable seal assembly with the accessory plug.

10. The water-resistant port of claim 9, wherein the moveable seal assembly further comprises an inner surface coupled to the spring structure, an outer surface, and a gasket material coupled to a side wall of the port casing.

11. The water-resistant port of claim 10, wherein the inner surface comprises a durable material and the outer surface comprises a seal material.

12. The water-resistant port of claim 9, wherein, in the relaxed position, a seal is created between the moveable seal assembly and a side wall of the port casing.

13. The water-resistant port of claim 9, wherein the one or more electrical connectors comprise:

leaf springs; or spring loaded connectors.

14. The water-resistant port of claim 9, wherein the accessory plug comprises:

a tip ring sleeve (TRS) plug;

a tip sleeve (TS) plug;

a tip ring ring sleeve (TRRS) plug;

a universal serial bus (USB) plug;

a high-definition multimedia interface (HDMI) plug; or a direct current (DC) plug.

15. A method of using a water-resistant port, the method comprising:

providing an accessory plug;

providing the water resistant port, comprising:

a port casing, a moveable seal assembly, a spring structure, a guide extending through a center of the spring structure, and one or more electrical connectors, the spring structure and the one or more electrical connectors each extending from an interior wall of the port casing, the spring structure coupled to the moveable seal assembly;

inserting the accessory plug into the port casing by depressing the moveable seal assembly with the accessory plug; and contacting the one or more electrical connectors with the accessory plug to provide an electrical connection between the accessory plug and the one or more electrical connectors.

16. The method of claim 15, wherein the one or more electrical connectors comprise:

leaf springs; or spring loaded connectors.

17. The water-resistant port of claim 15, wherein the one or more electrical connectors are moveably coupled to the interior wall.

18. The water-resistant port of claim 15, wherein the accessory plug comprises:

a tip ring sleeve (TRS) plug;

a tip sleeve (TS) plug;

a tip ring ring sleeve (TRRS) plug;

a universal serial bus (USB) plug;

a high-definition multimedia interface (HDMI) plug; or a direct current (DC) plug.

* * * * *